US007093646B2

(12) United States Patent
Nakayama et al.

(10) Patent No.: US 7,093,646 B2
(45) Date of Patent: Aug. 22, 2006

(54) DUAL ROLL CASTING MACHINE AND METHOD OF OPERATING THE CASTING MACHINE

(75) Inventors: Isamu Nakayama, Kanagawa (JP); Katsumi Nakayama, Kanagawa (JP); Shiro Osada, Kanagawa (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 99 days.

(21) Appl. No.: 10/490,739

(22) PCT Filed: Jul. 24, 2003

(86) PCT No.: PCT/JP03/09384

§ 371 (c)(1),
(2), (4) Date: Apr. 8, 2004

(87) PCT Pub. No.: WO2004/016371

PCT Pub. Date: Feb. 26, 2004

(65) Prior Publication Data

US 2004/0250980 A1 Dec. 16, 2004

(30) Foreign Application Priority Data

Aug. 12, 2002 (JP) ..... 2002-234995
Jun. 26, 2003 (JP) ..... 2003-182528

(51) Int. Cl.
*B22D 11/24* (2006.01)

(52) U.S. Cl. ..... 164/428; 164/415

(58) Field of Classification Search ..... 164/428, 164/480, 415, 417

See application file for complete search history.

(56) References Cited

U.S. PATENT DOCUMENTS

| | | | | |
|---|---|---|---|---|
| 5,720,335 | A * | 2/1998 | Osada et al. | 164/475 |
| 5,816,311 | A * | 10/1998 | Osada et al. | 164/415 |
| 5,960,855 | A * | 10/1999 | Assefpour-Dezfully et al. | 164/417 |
| 5,960,856 | A * | 10/1999 | Blejde et al. | 164/480 |
| 6,079,479 | A | 6/2000 | Osada et al. | |
| 6,273,178 | B1 | 8/2001 | Osada et al. | |
| 6,536,504 | B1 * | 3/2003 | Takeuchi et al. | 164/415 |

FOREIGN PATENT DOCUMENTS

| | | |
|---|---|---|
| EP | 726 112 | 8/1996 |
| EP | 780 177 | 6/1997 |
| JP | 1-166864 | 6/1989 |
| WO | 02/11924 | 2/2002 |

* cited by examiner

*Primary Examiner*—Len Tran
(74) *Attorney, Agent, or Firm*—Oblon, Spivak, McClelland, Maier & Neustadt, P.C.

(57) ABSTRACT

A twin roll casting machine that can reduce an amount of inert gas to be fed for prevention of oxidization. The machine includes an enclosure enclosing a strip in a range from chilled rolls to pinch rolls, a first swing wall within the enclosure and having a tip end movable toward and away from a surface of the strip, a sealing roll rotatably supported by the tip end of the first swing wall, a second swing wall within the enclosure and having a tip end movable toward and away from the other surface of the strip, a sealing roll rotatably supported by the tip end of the second swing wall, sealing members between peripheral edges of the swing walls and an inner surface of the enclosure, and conduits for supplying inert gas into the enclosure. The respective swing walls are swung to bring the sealing rolls close to the strip to thereby suppress flow of the inert gas from a first space to a second space.

12 Claims, 11 Drawing Sheets

DUAL ROLL CASTING MACHINE AND METHOD OF OPERATING THE CASTING MACHINE

TECHNICAL FIELD

The present invention relates to a twin roll casting machine and an operating method thereof.

BACKGROUND ART

FIG. 1 shows a conventional twin roll continuous casting machine based on an invention disclosed in JP-8-300108A.

This twin roll continuous casting machine comprises a pair of chilled rolls 1, a pair of side weirs 2 associated with the chilled rolls 1, a pair of pinch rolls 4 for pinching a strip 3 cast by the chilled rolls 1 and feeding the same to a succeeding process such as rolling, an enclosure 5 which has lateral walls confronting widthwise edges of the strip 3 and encloses a travel path of the strip 3 from the chilled rolls 1 to the pinch rolls 4, a sledding table 6 and a plurality of table rolls 7 within the enclosure 5, sealing members 8 contiguous with an upstream portion of the enclosure 5 in the direction of travel of the strip 3 so as to abut on outer peripheries of the respective chilled rolls 1 and sealing members 9 contiguous with a downstream portion of the enclosure 5 in the direction of travel of the strip 3 so as to abut on outer peripheries of the respective pinch rolls 4.

The chilled rolls 1 are horizontally arranged in parallel with each other, a nip between the rolls being adjustable to be increased or decreased depending upon thickness of the strip 3 to be cast.

Rolling directions and velocities of the chilled rolls 1 are set such that outer peripheries of the rolls are moved from above to the nip at the same velocity.

The chilled rolls 1 are structured such that cooling water may pass through the rolls.

One of the side weirs 2 is in surface contact with one ends of the respective chilled rolls 1 and the other side weir 2 is in surface contact with the other ends of the respective chilled rolls 1; molten metal is fed to a space defined by the side weirs 2 and the rolls 1 to form a molten metal pool 10.

Formation of the pool 10 and rotation of the rolls 1 which are being cooled cause the metal to solidify on the outer peripheries of the chilled rolls 1 so that the strip 3 is delivered downward from the nip.

The pinch rolls 4 are arranged downstream of the chilled rolls 1 and adjacent to a succeeding process to which the strip 3 is to be delivered.

The sledding table 6 is adapted to take two alternative postures, one for guidance of the strip 3 from the chilled rolls 1 to the pinch rolls 4 and the other not in contact with the strip 3.

The table rolls 7 are arranged to support from below the strip 3 passing via the sledding table 6 to the pinch rolls 4.

A scrap box 11 is arranged below and connected via a sealing member 80 to the enclosure 5 so as to be positioned properly under the chilled rolls 1; the scrap box 11 is adapted to withdraw any shape-defective strip 3 produced upon startup of the casting operation.

Inert gas (nitrogen gas) G is fed to the enclosure 5 and the scrap box 11 via a conduit 12 so as to retain the interior of the enclosure 5 in non-oxidative atmosphere and prevent the hot strip 3 from being oxidized.

The sealing members 8 and 9 respectively between the enclosure 5 and the chilled rolls 1 and between the enclosure 5 and the pinch rolls 4 suppress a flow of above-mentioned inert gas G outside.

However, in the twin roll casting machine shown in FIG. 1, under the influence of the hot molten metal pool 10, the more upstream in the direction of travel of the strip 3 a position in the enclosure 5 is, the higher the atmosphere temperature in the enclosure 5 is; moreover, the chilled rolls 1 are positioned at an-uppermost portion of the enclosure 5 so that, because of stack effect, the inert gas G may flow outside the enclosure 5 via between the chilled rolls 1 and the sealing members 8, and ambient air flows into the enclosure 5 via between the pinch rolls 4 and the sealing members 9 in an amount corresponding to the amount of inert gas G having flowed outside.

Therefore, the enclosure 5 must be replenished with inert gas G in an amount corresponding to that of the inert gas G flowed outside so as to prevent the strip 3 from being oxidized.

The invention was made in view of the above and has its object to provide a twin roll casting machine and an operating method thereof which can reduce an amount of inert gas to be fed for prevention of a strip from being oxidized.

SUMMARY OF THE INVENTION

In an embodiment of a twin roll casting machine according to the invention, gaps between the inner side surfaces of the enclosure and the peripheral edges of the first and second swing walls and are filled in by the swing-wall sealing members and the first and second swing walls are swung to bring the first and second sealing rolls close to the strip, thereby suppressing the flow of the inert gas from the pinch rolls to the chilled rolls.

In this state, the first and second sealing rolls are rotated so as to be in accordance with the travel direction of the strip, thereby relieving any damages upon abutment of the strip against these sealing rolls.

The stoppers on the first and second swing walls retain the gap between the first and second sealing rolls to be more than the maximum thickness of the strip, thereby preventing the strip from being pinched by the first and second sealing rolls.

The first and second actuators are actuated by the control mechanism such that the predetermined spacing is retained between the first and second sealing rolls rotatably supported by the first and second swing walls, thereby making constant the gaps between the strip and the respective sealing rolls.

In a further embodiment of a twin roll casting machine according to the invention, a gap between the inner surface of the enclosure and the peripheral edge of the third swing wall is filled in by the swing-wall sealing member, the third swing wall is swung to bring the sealing roll close to the strip, thereby suppressing the flow of the inert gas from the pinch rolls to the chilled rolls.

In this state, the third sealing roll is rotated so as to be in accordance with the travel direction of the strip, thereby relieving any damages upon abutment of the strip against the sealing roll.

The gap between the third sealing roll and the table roll is retained to be more than the maximum thickness of the strip by the stoppers adapted to regulate the swinging movement of the swing wall, thereby preventing the strip from being pinched by the third sealing roll and the table roll.

In a further embodiment of a twin roll casting machine according to the invention, the chilled-roll sealing members are brought close to the respective chilled rolls to minimize the spacings of the sealing members to the outer peripheries of the chilled rolls within an extent of not hindering the rotation of the chilled rolls, thereby suppressing flowing of the inert gas from within the enclosure to outside.

The cooling medium is continuously fed from the cooling-medium supply means into the chilled-roll sealing members so as to prevent the chilled-roll sealing members from being thermally deformed.

In an operation method of a twin roll casting machine according to the invention, the sealing rolls are rotated at the peripheral velocity equal to a travel velocity of the strip, thereby preventing any significant scratch marks on the strip upon abutment of the strip against the respective sealing rolls.

BEST MODE FOR CARRYING OUT THE INVENTION

Embodiments of the invention will be described with reference to the drawings so as to further detailedly disclose the invention.

Figure 1:
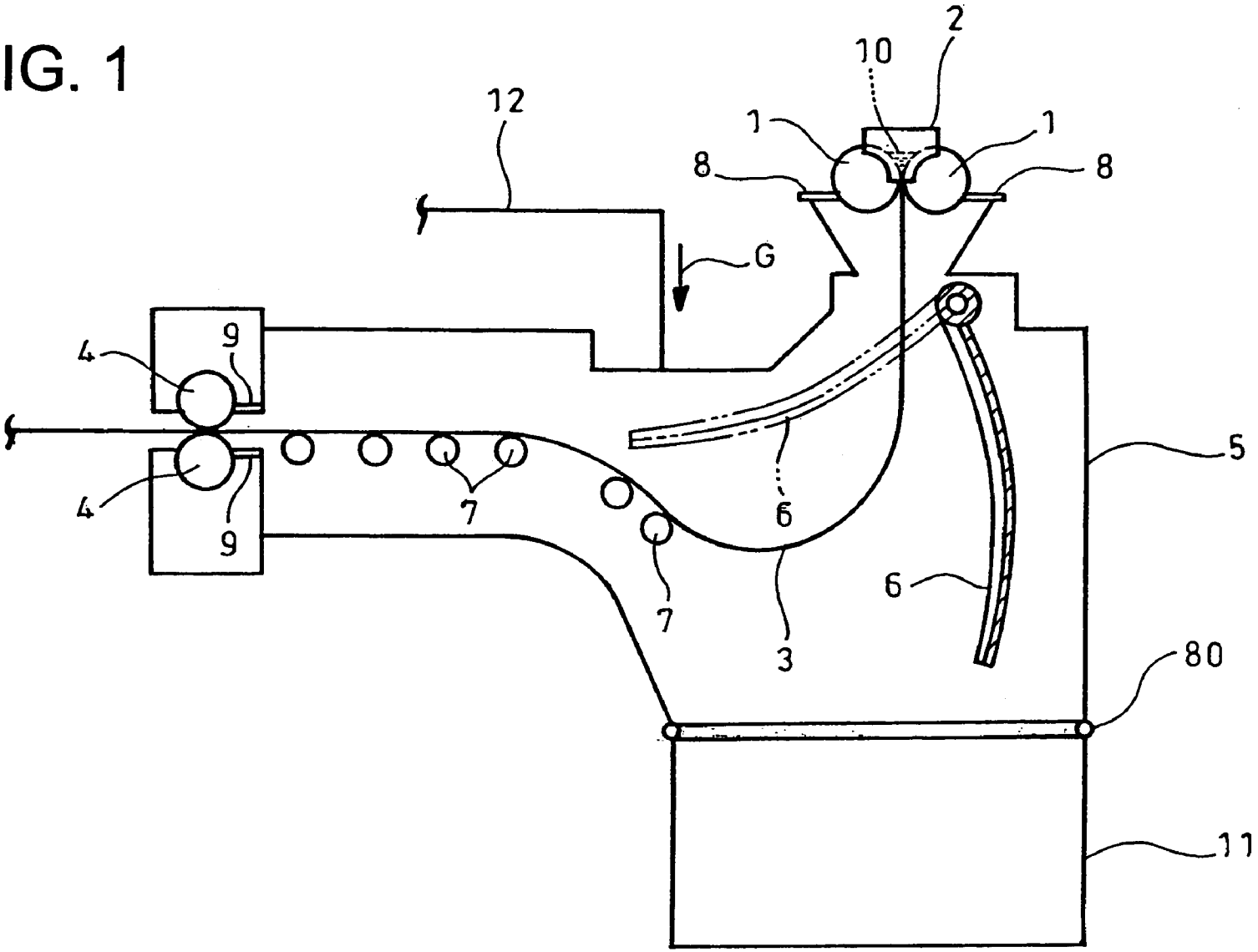
FIG. 1 is a schematic view showing a conventional twin roll casting machine.
Figure 2:
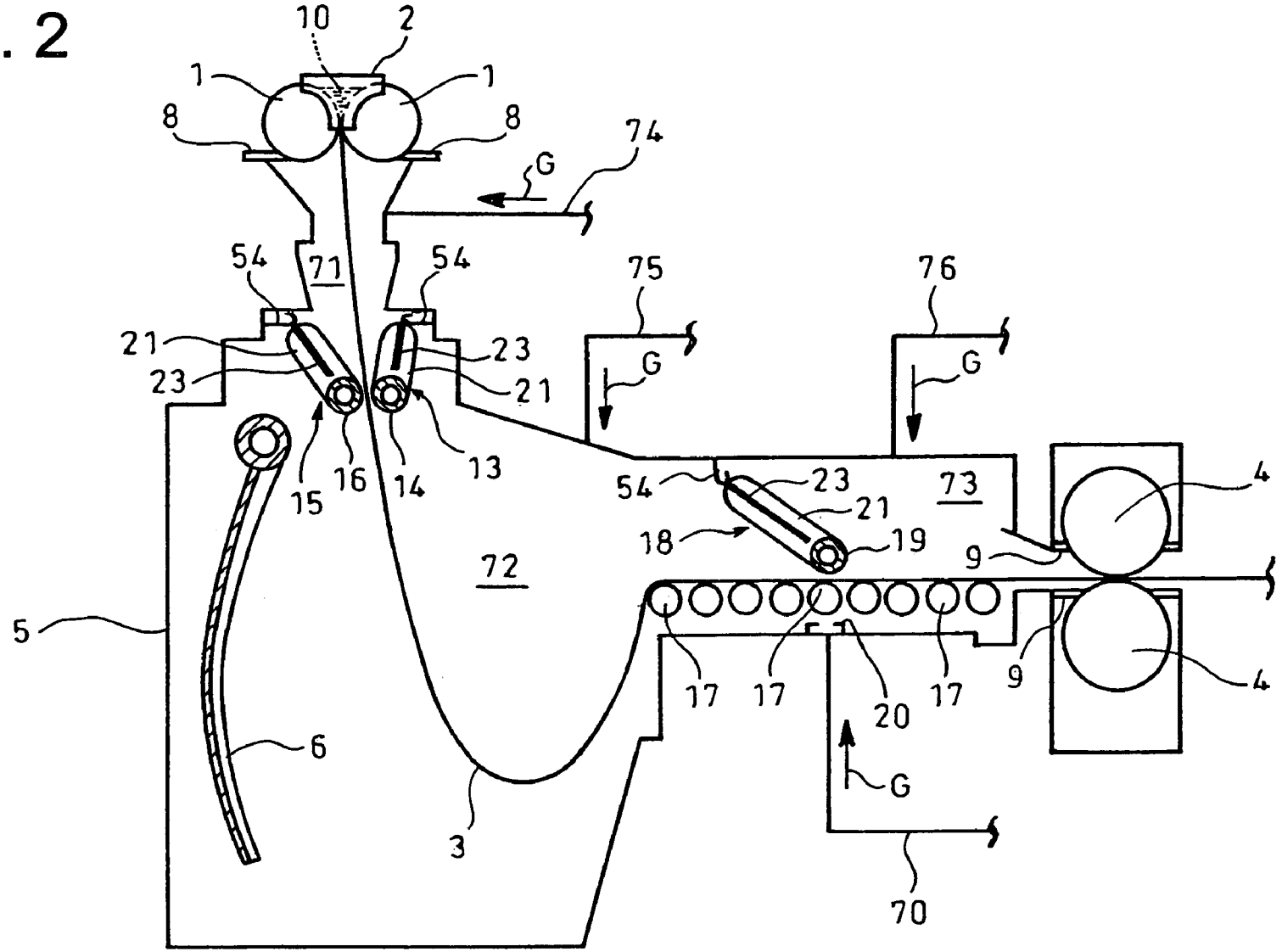
FIG. 2 is a schematic view showing a first embodiment of a twin roll casting machine according to the invention.
Figure 3:
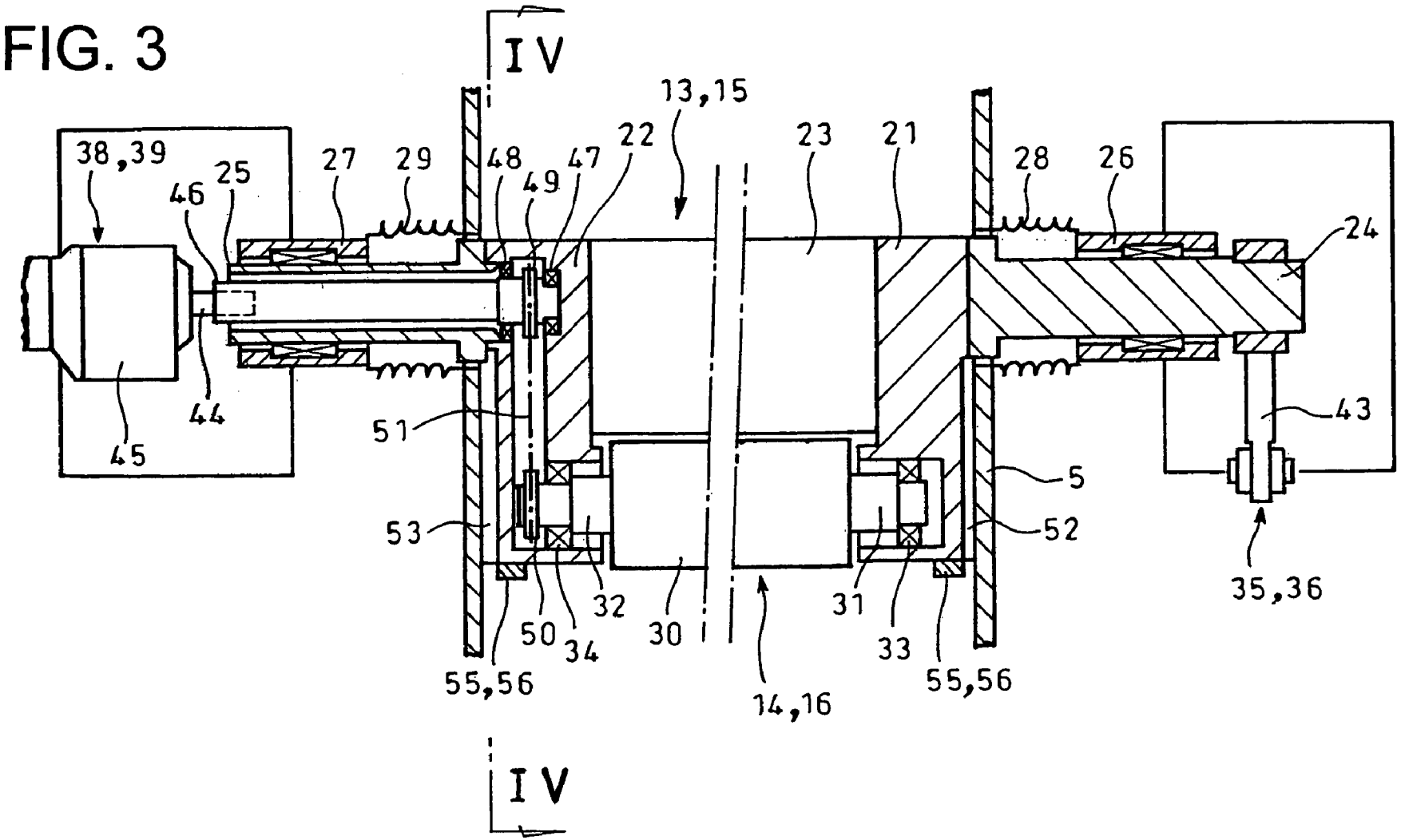
FIG. 3 is a sectional view of the swing wall and the sealing roll arranged upstream in the direction of travel of the strip with reference to FIG. 1.
Figure 4:
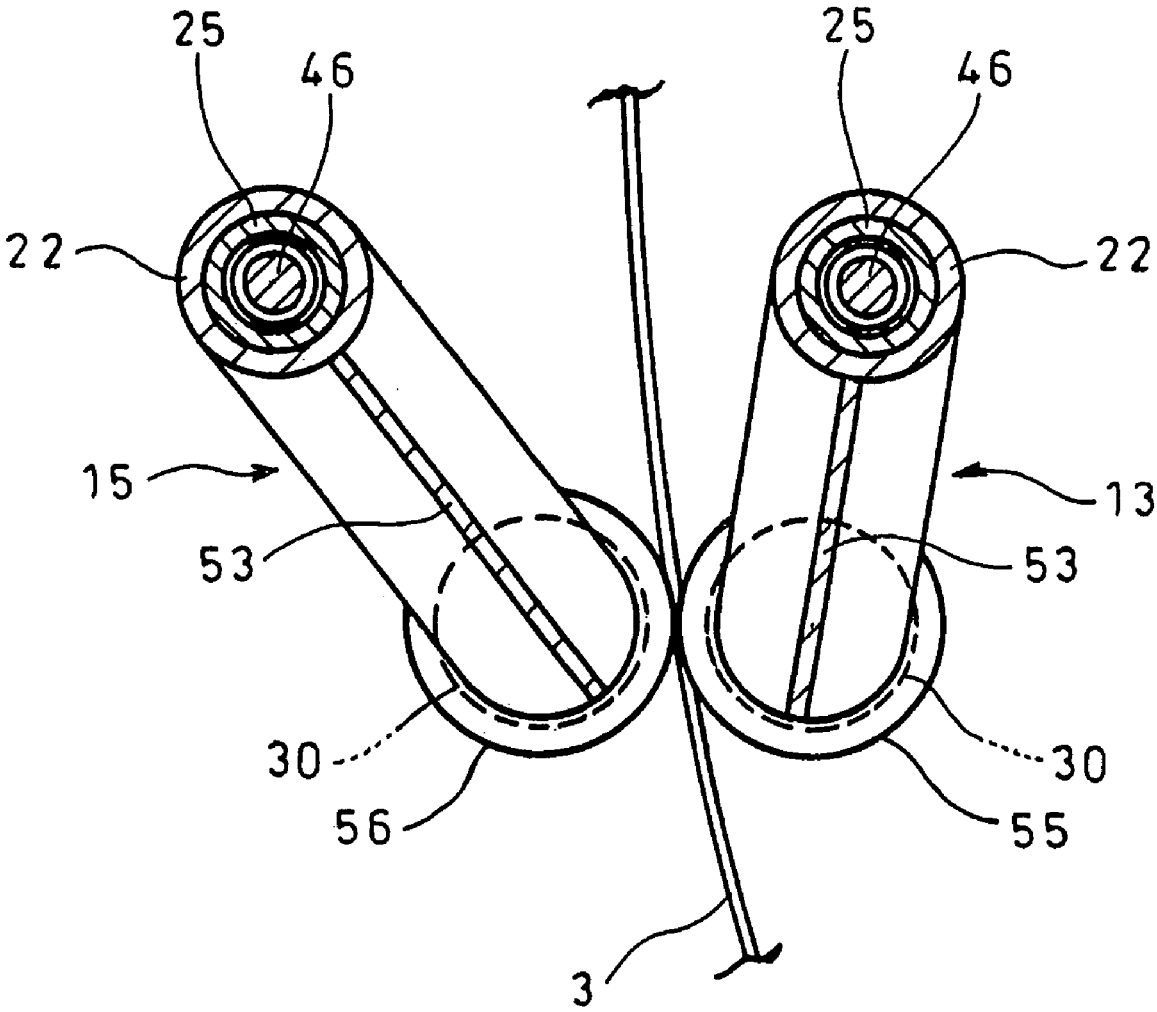
FIG. 4 is a view looking in the direction of arrows III in FIG. 2.
Figure 5:
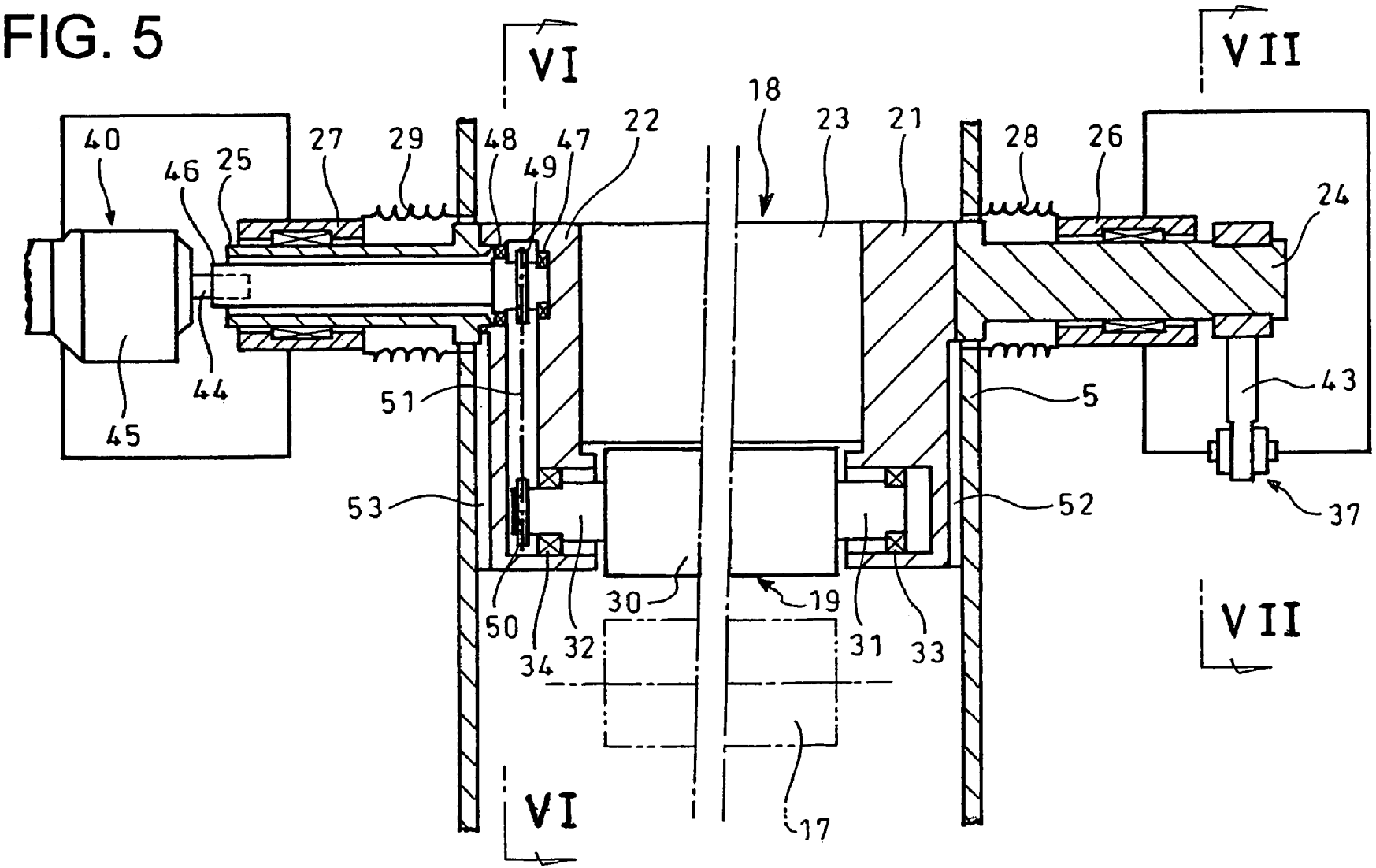
FIG. 5 is a sectional view of the swing wall and the sealing roll arranged downstream in the direction of travel of the strip with reference to FIG. 1.
Figure 6:
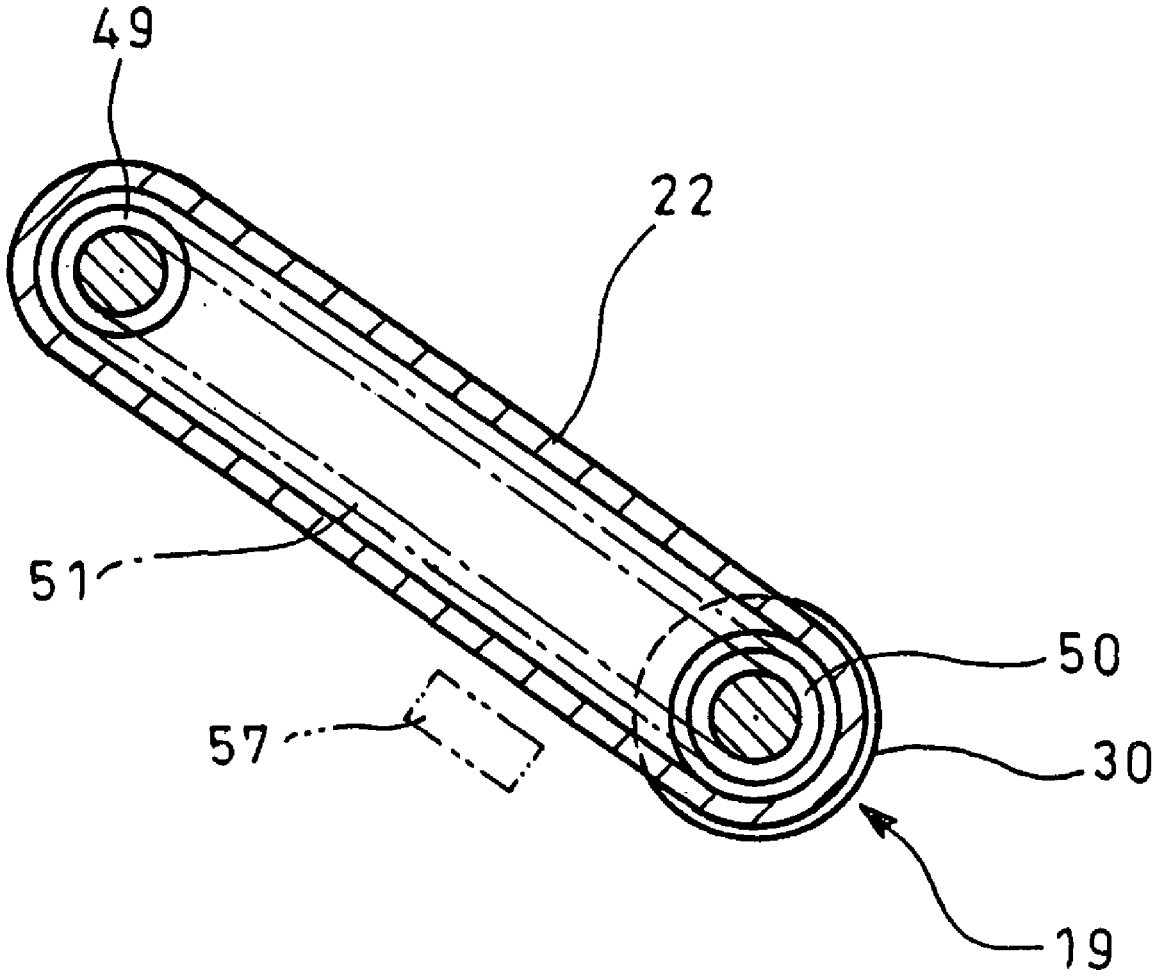
FIG. 6 is a view looking in the direction of arrows V in FIG. 4.
Figure 7:
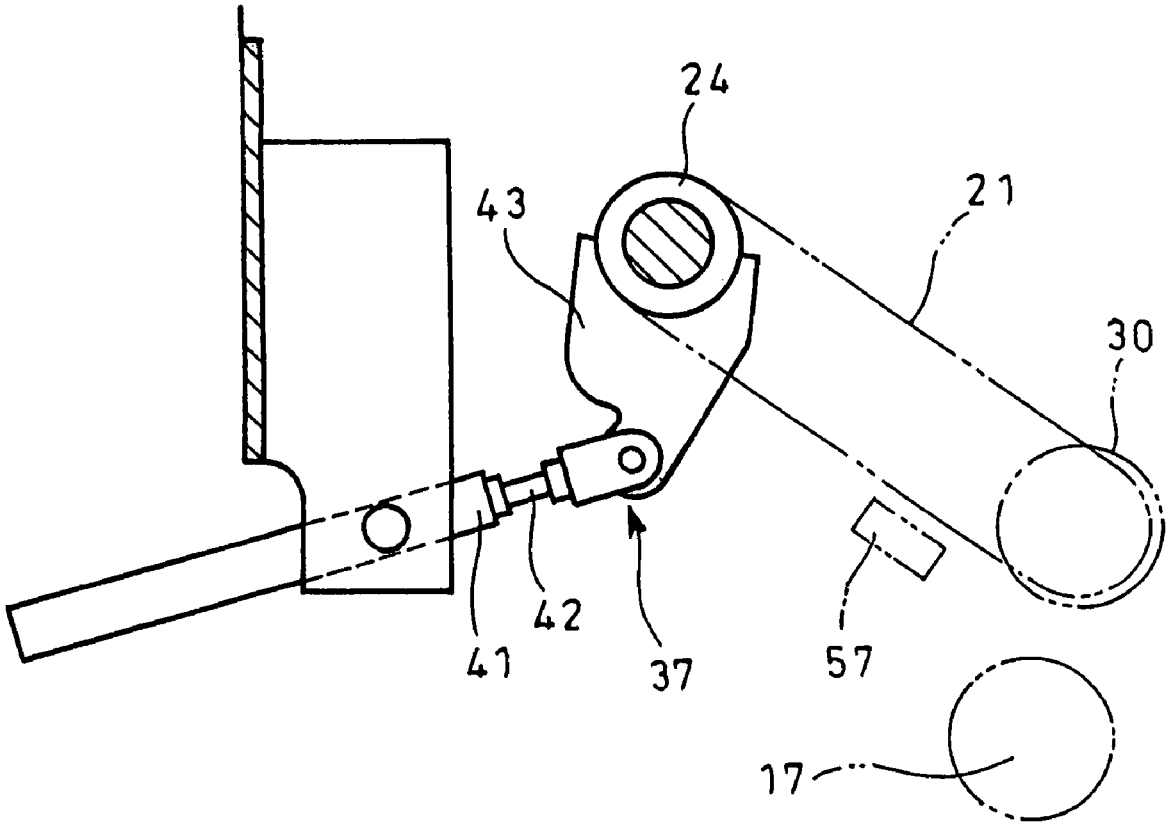
FIG. 7 is a view looking in the direction of arrows VI in FIG. 4.

FIGS. 2–8 show a first embodiment of a twin roll casting machine according to the invention in which the same parts as those in FIG. 1 are represented by the same reference numerals.

This twin roll casting machine comprises a swing wall 13 arranged within an enclosure 5 and having a tip end movable toward and away from one surface of a strip 3 (on which an upper pinch roll 4 abuts), a sealing roll 14 rotatably supported by the tip end of the swing wall 13 in parallel with the chilled rolls 1, a swing wall 15 arranged within the enclosure 5 and having a tip end movable toward and away from the other surface of the strip 3 (on which a lower pinch roll 4 abuts), a sealing roll 16 rotatably supported by the tip end of the swing wall 15 in parallel with the chilled rolls 1, a plurality of table rolls 17 arranged within the enclosure 5 so as to substantially horizontally convey the strip 3 from the sealing rolls 14 and 16 to the pinch rolls 4, a swing wall 18 arranged within the enclosure 5 above the table rolls 17 and having a tip end movable toward and away from the one surface of the strip 3, a sealing roll 19 rotatably supported by the tip end of the swing wall 18 in parallel with the chilled rolls 1 and a gas chamber 20 for discharging inert gas G from below to the table roll 17 to which the sealing roll 19 is to be brought close.

Each of the swing walls 13, 15 and 18 comprises arms 21 and 22 arranged along lateral walls of the enclosure 5, a partition plate 23 between the arms 21 and 22 with its lateral edges being fixed to portions of the arms 21 and 22 from base ends of the arms to vicinities of tip ends of the arms, a support shaft 24 connected to the base end of one 21 of the arms and rotatably penetrating through the side wall of the enclosure 5, a hollow support shaft 25 connected to the base end of the other arm 22 and rotatably penetrating through the side wall of the enclosure 5 and bearings 26 and 27 arranged outside of the enclosure 5 and rotatably supporting the support shafts 24 and 25.

Arranged between the bearings 26 and 27 and the enclosure 5 are bellows-type sealing members 28 and 29 so as to circumferentially surround the support shafts 24 and 25, respectively.

The sealing members 28 and 29 have one ends fitted to end faces of the bearings 26 and 27 and the other ends, outer surfaces of the side walls of the enclosure 5, respectively.

Each of the sealing rolls 14, 16 and 19 comprises a cylindrical barrel 30 and bosses 31 and 32 fitted into opposite ends of the barrel 30.

The one 31 and the other 32 of the bosses are rotatably supported via the bearings 33 and 34 by the vicinities of the tip ends of the arms 21 and 22, respectively, so as to minimize spacings of outer peripheries of the sealing rolls 14, 16 and 19 to edges of the corresponding partition plates 23.

The above-mentioned swing walls 13, 15 and 18 are adapted to be swung by swing mechanisms 35, 36 and 37, respectively, and the sealing rolls 14, 16 and 19 are adapted to be rotated by drive mechanisms 38, 39 and 40, respectively.

Each of the swing mechanisms 35, 36 and 37 comprises a trunnion-shaped cylinder 41 arranged outside of the enclosure 5 and expansible and contractible to the travel direction of the strip and a lever 43 fitted over an end of the support shaft 24 and connected with a piston rod 42 of the cylinder 41.

The expansion and contraction of the cylinders 41 are transmitted via the levers 43 to the support shafts 24 of the swing walls 13, 15 and 18, which causes the sealing rolls 14, 16 and 19 to be moved towards and away from the strip 3.

Each of the drive mechanisms 38, 39 and 40 comprises a motor 45 arranged outside of the enclosure 5 so as to make its drive shaft 44 precisely confront the support shaft 25, an intermediate shaft 46 penetrating through the support shaft 25 and having one end fitted over the drive shaft 44, a sprocket 49 rotatably supported via bearings 47 and 48 in the base end of the arm 22 and fitted over the other end of the intermediate shaft 46, a sprocket 50 arranged in the tip end of the arm 22 and fitted over the boss 32 of the other end of the sealing roll 14, 16 or 19 and an endless chain 51 wound around the sprockets 49 and 50.

Rotation of the drive shaft 44 for the motor 45 is transmitted via the intermediate shaft 46, the sprocket 49, the chain 51, the sprocket 50 to the boss 32, which causes the sealing roll 14, 16 or 19 to rotate.

Thus, provided that the respective sealing rolls 14, 16 and 19 are rotated at the peripheral velocity in accordance with the travel velocity of the strip 3 from the chilled rolls 1 to the pinch rolls 4, no significant scratch marks are formed on the strip 3 even if the strip 3 may meander in the direction of its thickness to bring the strip into abutment with the outer peripheries of the sealing rolls 14, 16 and 19.

Mounted over the arms 21 and 22 of the swing walls 13, 15 and 18 are the sealing members 52 and 53 extending from base ends to tip ends of the arms, such that the sealing members may slide along the side walls of the enclosure 5.

Mounted on inner side surface portions of the enclosure 5 close to the base ends of the swing walls 13, 15 and 18 are laterally extending sealing members 54, such that the sealing members may slide on the base ends of the arms 21 and 22 and on upper ends of the partition plates 23.

These sealing members 52, 53 and 54 are made from material which is thermally resistant and elastically deformable.

More specifically, gaps between the swing walls 13, 15 and 18 and the inner side surfaces of the enclosure 5 are filled in by the sealing members 52, 53 and 54.

Stoppers 55 are arranged on the tip ends of the arms 21 and 22 of the swing wall 13, and stoppers 56 are arranged on the tip ends of the arms 21 and 22 of the swing wall 15 so as to abut on the stoppers 55.

The stoppers 55 and 56 are shaped such that when the tip ends of the swing walls 13 and 15 are moved towards each other to make the stoppers 55 and 56 into abutment to each other, a gap between the barrels 30 of the sealing rolls 14 and 16 is of a value not less than a maximum thickness of the strip 3 cast by the chilled rolls 1.

As a result, the sealing rolls 14 and 16 do not pinch the strip 3 even if the stoppers 55 and 56 abut on each other, a predetermined gap being retained with respect to the strip 3.

The inner surface of the enclosure 5 is provided with stoppers 57 which confront, from below, the arms 21 and 22 of the swing wall 18.

The stoppers 57 are positioned such that when the tip end of the swing wall 18 is brought close to the table rolls 17, a spacing between the barrel 30 of the sealing roll 19 and the corresponding table roll 17 is not less than the maximum thickness of the strip 3 cast by the chilled rolls 1.

As a result, the table roll 17 and the sealing roll 19 do not pinch the strip 3 even if the arms 21 and 22 abut on the stoppers 57, a predetermined gap being retained with respect to the strip 3.

The swing mechanisms 35 and 36 for the swing walls 13 and 15 are equipped with a control mechanism 58.

Figure 8:
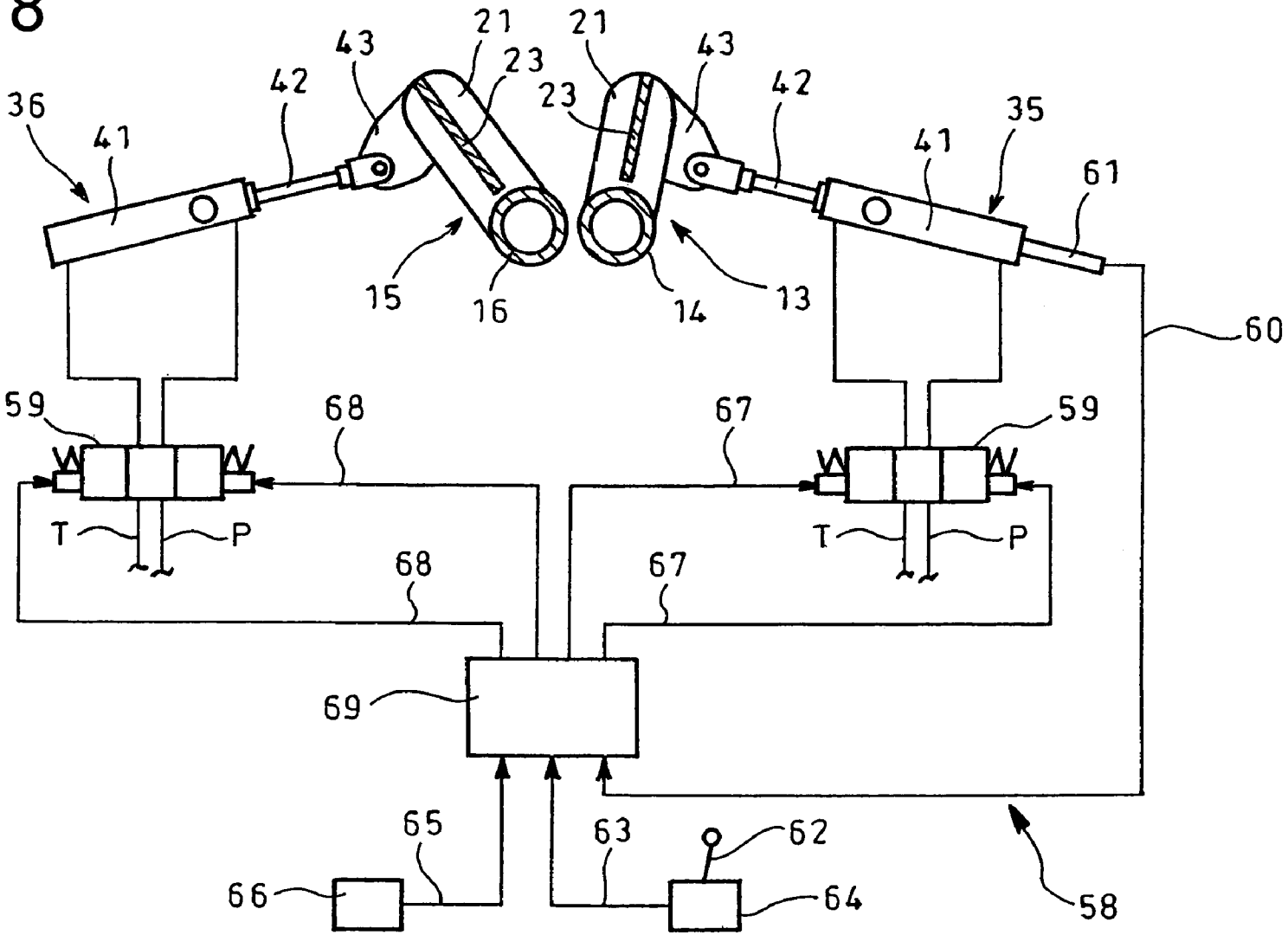
FIG. 8 is a schematic view showing the swing mechanism and the control mechanism therefor with reference to FIG. 1.

The control mechanism 58 comprises flow path changeover valves 59 each for each of the cylinders 41, a position detector 61 which is fitted into the cylinder 41 assembled in the swing mechanism 35 and transmits a detection signal 60 depending upon a position of the piston rod 42, a position setter 64 which has a manually tiltable operating handle 62 and transmits a command signal 63 depending upon a tilt angle of the same, an release commander 66 which transmits a command signal 65 through manual operation and a controller 69 which transmits to the changeover valves 59 changeover signals 67 and 68 depending upon the detection and command signals 60, 63 and 65 (see FIG. 8).

The flow path changeover valve 59 is adapted to be set, depending upon the changeover signals 67 and 68 from the controller 69, to either of states, i.e., the state where rod- and head-side fluid chambers of the cylinder 41 are isolated to outside, the state where the rod- and head-side fluid chambers of the cylinder 41 are communicated with pump and tank ports P and T, respectively, and the state where the head- and rod-side fluid chambers of the cylinder 41 are communicated with the pump and tank ports P and T, respectively.

The controller 69 transmits, on the basis of the command signal 63 from the position setter 64, the changeover signal 67 to the flow path changeover valve 59 connected to the cylinder 41 of the one swing mechanism 35 and transmits, on the basis of the detection signal 60 from the position detector 61, the changeover signal 68 to the flow path changeover valve 59 connected to the cylinder 41 of the other swing mechanism 36 to thereby activate the respective cylinders 41 such that the swing wall 15 is swung to follow the swing wall 13 with the sealing rolls 14 and 16 being in a predetermined distance.

Upon receipt of the command signal 65 from the release commander 66, it transmits the changeover signals 67 and 68 to the respective flow path changeover valves 59 to activate the respective cylinders 41 such that the swing walls 13 and 15 are swung to move the sealing rolls 14 and 16 away from each other.

The gas chamber 20 is a hollow structure with a top opening adapted to discharge inert gas G and is arranged on an inner bottom of the enclosure 5 so as to be positioned below the table roll 17 to which the sealing roll 19 is to be brought close.

An interior of the gas chamber 20 is fed with the inert gas G via a conduit 70.

The enclosure 5 has spaces 71, 72 and 73 to which conduits 74, 75 and 76 are connected, respectively, for supply of the inert gas G, the spaces 71, 72 and 73 being defined between the chilled rolls 1 and the swing walls 13 and 15, between the swing walls 13 and 15 and the swing wall 18 and between the swing wall 18 and the pinch rolls 4, respectively.

The mode of operation of the twin roll casting machine shown in FIGS. 2–8 will be described.

Before starting a casting operation of the strip 3, the interior of the enclosure 5 is fed with the inert gas G via the conduits 74, 75 and 76 to have non-oxidative atmosphere.

Then, the release commander 66 is manually operated to transmit the command signal 65 to the controller 69 which in turn transmits the changeover signals 67 and 68 to set the flow path changeover valves 59 connected to the respective cylinders 41 of the swing mechanisms 35 and 36 such that the cylinders 41 are actuated to move the tip ends of the swing walls 13 and 15 away from each other, thereby withdrawing the sealing rolls 14 and 16 into positions away from the travel path of the strip 3.

Moreover, the cylinder 41 of the swing mechanism 37 is actuated to move the tip end of the swing wall 18 away from the table roll 17, thereby withdrawing the sealing roll 19 away from the travel path of the strip 3.

Under such conditions, molten metal is fed to the space defined by the side weirs 2 and the chilled rolls 1 to form the molten metal pool 10, and the chilled rolls 1 are rotated to deliver downward the strip 3 from the nip between the rolls.

Then, the strip 3 is guided by the sledding table 6 via the table rolls 17 to the pinch rolls 4 where the strip 3 is fed to the succeeding process.

The motors 45 of the drive mechanisms 38, 39 and 40 are actuated to rotate the sealing rolls 14, 16 and 19 at the peripheral velocity depending upon the travel direction and velocity of the strip 3.

Then, the operating handle 62 of the position setter 64 is manually operated to transmit the command signal 63 to the controller 69 so as to swing the swing wall 13 such that the sealing roll 14 is brought close to the strip 3.

As a result, the controller 69 transmits the changeover signal 67 to the flow path changeover valve 59 connected to the cylinder 41 of the one swing mechanism 35 and transmits, on the basis of the detection signal 60 from the position detector 61, the changeover signal 68 to the flow path changeover valve 59 connected to the cylinder 41 of the other swing mechanism 36 such that the respective cylinders 41 are actuated to swing the swing wall 15 to follow the swing wall 13 with sealing rolls 14 and 16 being in the predetermined distance, thereby decreasing the distances of the sealing roll 14 and 16 to the strip 3 into substantially constant.

As mentioned above, the gaps between the swing walls 13 and 15 and the inner side surfaces of the enclosure 5 are filled in by the sealing members 52, 53 and 54, so that the spaces 71 and 72 partitioned by the swing walls 13 and 15 intercommunicate only through small gaps between the respective sealing rolls 14 and 16 and the strip 3, thereby suppressing the flow of the inert gas G from the space 72 to the space 71 due to difference in atmosphere temperature between the spaces 71 and 72.

The distance between the sealing rolls 14 and 16 is kept to be more than the maximum thickness of the strip 3 even when the stoppers 55 and 56 of the arms 21 and 22 abut on each other, so that the strip 3 is prevented from being pinched by the sealing rolls 14 and 16 and is prevented from having non-uniform thickness.

In addition, even if the strip 3 may abut on the sealing rolls 14 and 16 due to meandering of the strip in its thickness direction or due to any improper postures of the swing walls 13 and 15, the sealing rolls 14 and 16 are rotated at the peripheral velocity depending upon the travel direction and velocity of the strip 3 so that no significant scratch marks are formed on the strip 3.

Moreover, the cylinder 41 of the swing mechanism 37 is actuated to move the tip end of the swing wall 18 toward the table rolls 17 and move the sealing roll 19 toward the travel path of the strip 3 to thereby decrease the distance of the sealing roll 19 to the strip 3 while the inert gas G is continuously fed from the conduit 70 to the gas chamber 20.

The gap between the swing wall 18 and the inner surface of the enclosure 5 is filled in by the sealing members 52, 53 and 54 and the inert gas G is discharged from the gas chamber 20 to the table roll 17, so that the spaces 72 and 73 partitioned by the swing wall 18 intercommunicate only through smaller gaps between the sealing roll 19 and the table roll 17 on the one hand and the strip 3 on the other hand, thereby suppressing the flow of the inert gas G from the space 73 to the space 72 due to difference in atmosphere temperature between the spaces 72 and 73.

The distance between the sealing roll 19 and the table roll 17 is retained to be more than the maximum thickness of the strip 3 even if the arms 21 and 22 abut on the stoppers 57, so that the strip 3 is prevented from being pinched by the sealing roll 19 and the table roll 17 and prevented from having non-uniform thickness.

In addition, even if the strip 3 abuts on the sealing roll 19 due to meandering of the strip 3 in its thickness direction or due to improper posture of the swing wall 18, the sealing roll 19 is rotated at the peripheral velocity depending upon the travel direction and the velocity of the strip 3, so that no significant scratch marks are formed on the strip 3.

The swing mechanisms 35, 36 and 37 and the drive mechanisms 38, 39 and 40 are arranged outside of the enclosure 5, which facilitates repair and maintenance operations of them.

The gaps between the side walls of the enclosure 5 and the support shafts 24 and 25 connected to the respective swing walls 13, 15 and 18 are filled in by the sealing members 28 and 29 so that the air-tightness of the enclosure 5 is not lowered.

Thus, in the twin roll casting machine shown in FIGS. 2–8, under the influence of the molten metal pool 10, the more upstream in the direction of travel of the strip 3 a position in the enclosure 5 is, the higher the atmosphere temperature in the enclosure 5 is; the inert gas G in the space 71 may be discharged outside of the enclosure 5 via between the chilled rolls 1 and the sealing members 8. However, the swing walls 13 and 15, the sealing rolls 14 and 16 and the sealing members 52, 53 and 54 associated with the swing walls 13 and 15 suppress the flow of the inert gas G from the space 72 to the space 71; and concurrently, the swing wall 18, sealing roll 19, the sealing members 52, 53 and 54 associated with the swing wall 18 as well as the inert gas G discharged from the gas chamber 20 to the table roll 17 suppress the flow of the inert gas G from the space 73 to the space 72. As a result, flow of ambient air into the enclosure 5 via between the pinch rolls 4 and the sealing members 9 can be suppressed.

As a result, the amount of the inert gas G to be fed for prevention of the hot strip 3 from being oxidized can be reduced.

Figure 9:
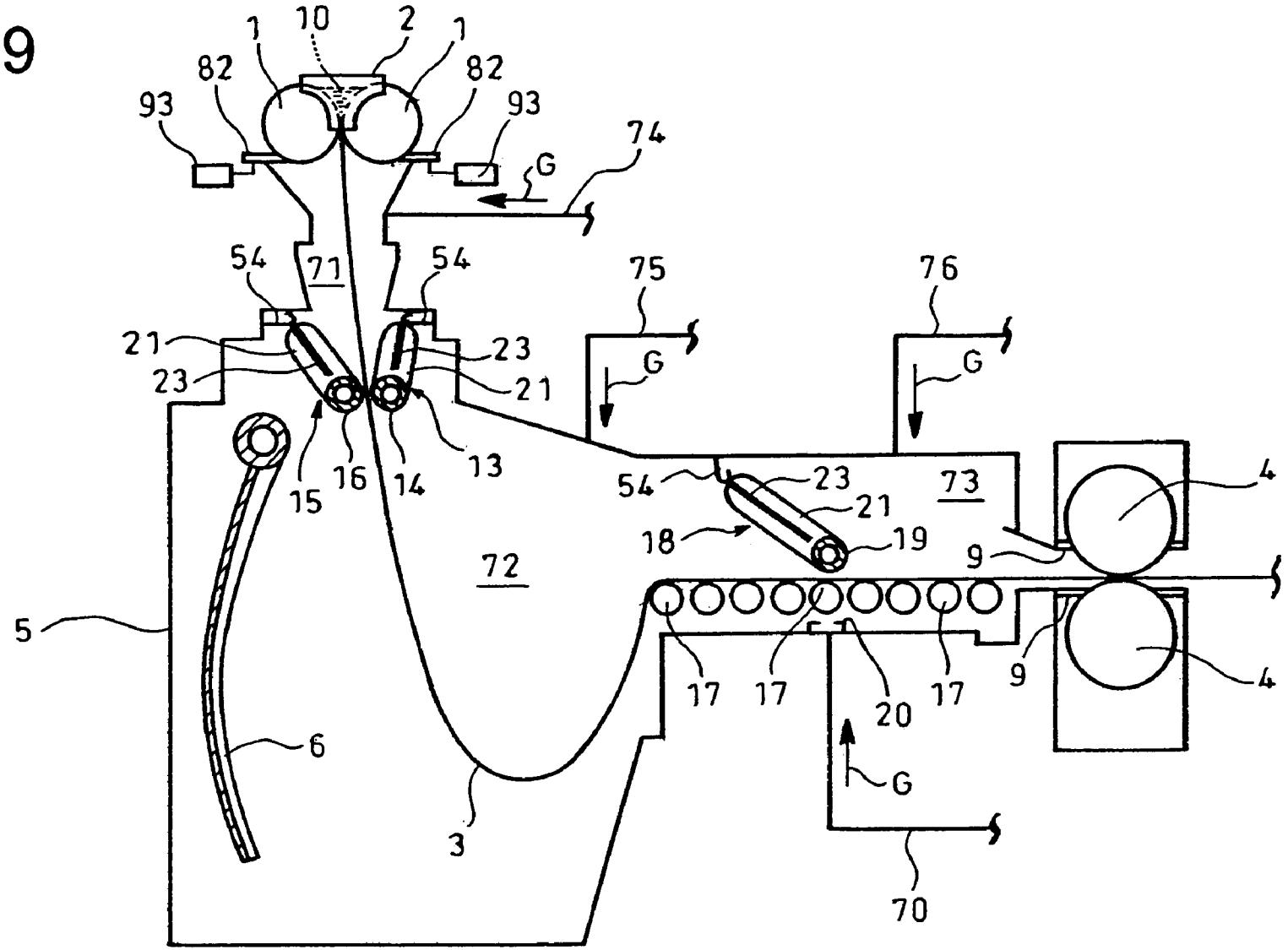
FIG. 9 is a schematic view showing a second embodiment of a twin roll casting machine according to the invention.
Figure 10:
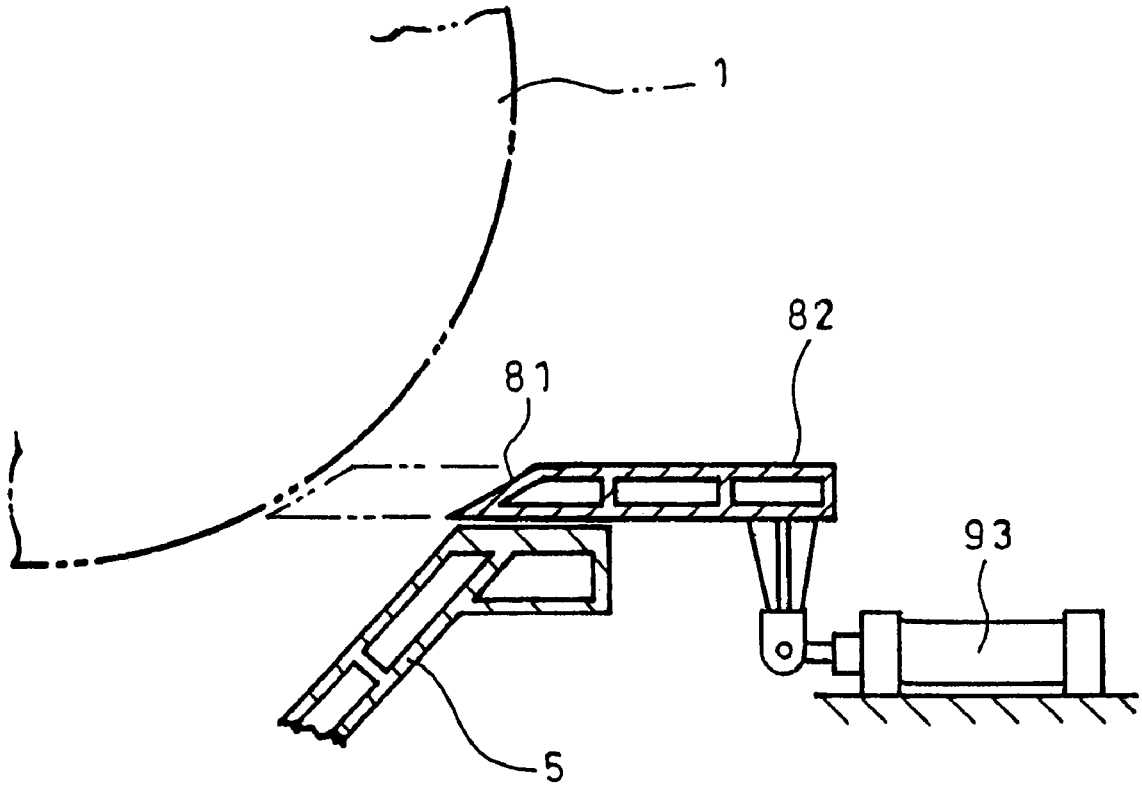
FIG. 10 is a partial vertical sectional view of the enclosure and the sealing member with reference to FIG. 9.
Figure 11:
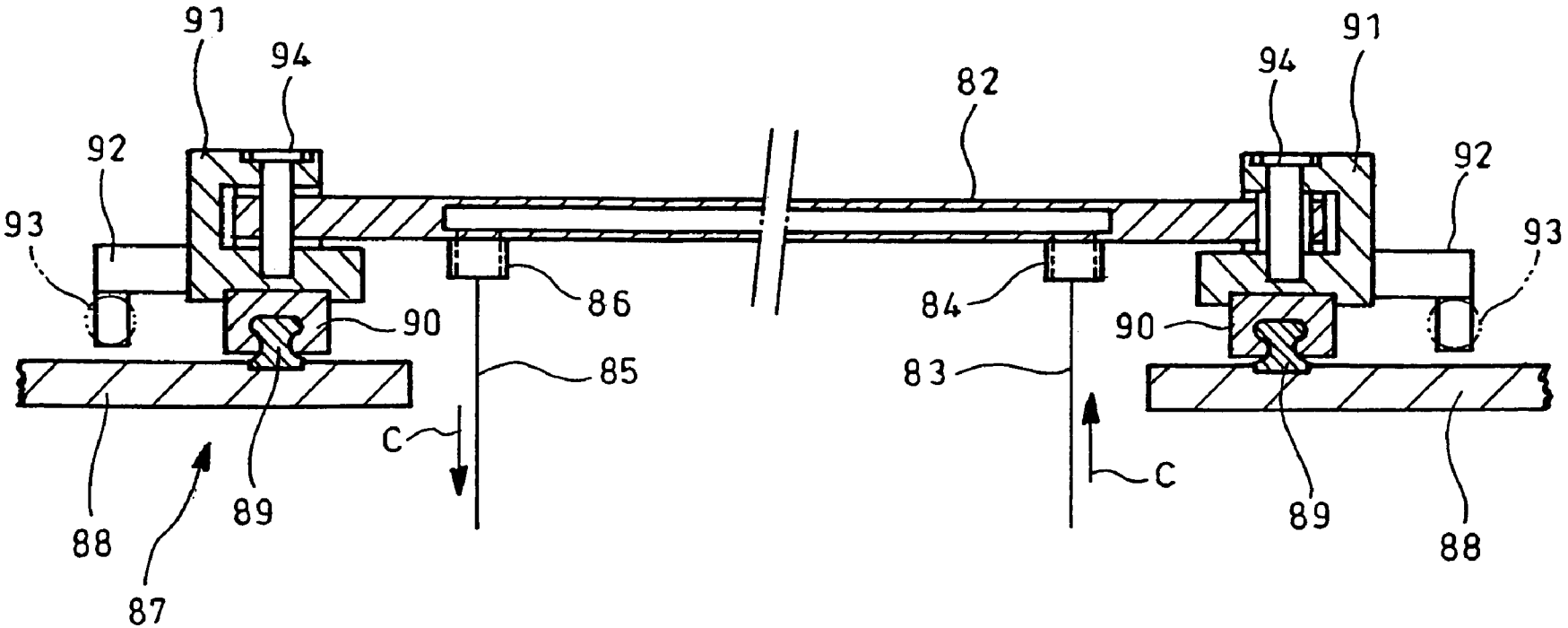
FIG. 11 is a sectional view of the sealing member with reference to FIG. 9.

FIGS. 9–11 show a second embodiment of a twin roll casting machine according to the invention in which the same parts as those in FIGS. 2–8 are represented by the same reference numerals.

In this twin roll casting machine, in lieu of the sealing members 8 (see FIG. 2) and for each of the chilled rolls 1, a hollow sealing member 82 with a sealing edge 81 in parallel with the axis of the chilled roll 1 is arranged such that the sealing edge 81 confronts and is movable toward and away from an outer periphery of the chilled roll 1.

The sealing member 82 has an inlet 84 for guiding cooling medium (cooling water) C from a conduit 83 into the member and an outlet 84 for discharging the cooling medium C from within the member to a conduit 85.

The sealing member 82 has therein a passage-forming member so as to increase a travel distance of the cooling medium C and enhance its cooling effect.

The sealing member 82 is adapted to be horizontally moved by a traverse mechanism 87.

The traverse mechanism 87 comprises a pair of base plates 88 spaced apart from each other axially of the chilled roll 1, guide members 89 on the base plates 88 and perpendicular to the axis of the chilled roll 1, seats 90 movable and fitted over the guide members 89, brackets 91 fitted on the movable seats 90, arms 92 protruded sideways from the brackets 91, and cylinders 93 with their piston rods connected to the arms 92 and with their housings connected to the base plates 88.

The sealing member 82 is positioned between and connected to the brackets 91 by vertically extending pins 94.

Clearances of the sealing member 82 through which one of the pins 94 extends are set to be of larger size, allowing for thermal expansion beforehand.

Expansion and contraction of the cylinders 93 are transmitted via the arms 92 to the brackets 91 and movable seats 90 so that the sealing edge 81 of the sealing members 8 is moved toward and away from the outer periphery of the chilled roll 1.

The cylinder 93 may be arranged such that, as shown in FIGS. 9 and 10, extension of its rod causes the sealing member 82 to be moved toward the chilled roll 1; alternatively and inversely, the arrangement may be such that withdrawal of the rod causes the sealing member 82 to be moved toward the chilled roll 1.

The mode of operation of the twin roll casting machine shown in FIGS. 9 to 11 will be described.

Before starting a casting operation of the strip 3, the interior of the enclosure 5 is fed with the inert gas G to have non-oxidative atmosphere.

Then, the cylinders 93 are expanded to bring the sealing members 82 close to the chilled rolls 1 and minimize the spacing between the sealing edges 81 and the outer peripheries of the chilled rolls 1 to an extent of not hindering the rotation of the chilled rolls 1.

The cooling medium C is continuously passed through the sealing members 82 by means of the conduits 83 and 85.

Under such conditions, molten metal is fed to the space defined by the side weirs 2 and the chilled rolls 1 to form the molten metal pool 10, and the chilled rolls 1 are rotated to deliver downward the strip 3 from the nip between the rolls.

Then, the flow of the inert gas G from inside of the enclosure 5 to outside can be suppressed since the spacings between the sealing edges 81 and the outer peripheries of the chilled rolls 1 are narrowed and the cooling medium C prevents the sealing members 82 being thermally deformed.

Moreover, as mentioned above, the flow of the inert gas G from the space 72 to the space 71 is suppressed by the swing walls 13 and 15, the sealing rolls 14 and 16 and the sealing members 52, 53 and 54; and the flow of the inert gas G from the space 73 to the space 72 is suppressed by the swing wall 18, the sealing roll 19, the sealing members 52, 53 and 54 and the inert gas G flowing from the gas chamber 20 toward the table rolls 17.

As a result, in the twin roll casting machine shown in FIGS. 9 to 11, main suppression of the flow-out of the inert gas G by the sealing members 82 is combined with additive suppression of the flow of the inert gas G by the swing walls 13, 15 and 18, the sealing rolls 14, 16 and 19 and the sealing members 52, 53 and 54, whereby the amount of the inert gas to be fed can be decreased to prevent the hot strip 3 from being oxidized.

Depending upon a capacity of the enclosure 5 and/or interior temperature conditions, the amount of the inert gas G to be fed may be decreased by the sealing members 82 and the sealing roll 19, without using the sealing rolls 14 and 16.

It is to be understood that a twin roll casting machine and an operating method thereof according to the invention is not limited to the above-mentioned embodiments.

More specifically, depending upon operational conditions in continuous casting, a twin roll continuous casting machine may be provided which has both the first and second sealing rolls and the chilled-roll sealing members; alternatively, a twin roll continuous casting machine may be provided which has both the sealing roll and table rolls and the chilled-roll sealing members.

Moreover, the sealing roll and table rolls may be arranged in an enclosure positioned between the pinch rolls and an inline mill downstream thereof.

What is claimed is:

1. A twin roll casting machine comprising:

a pair of chilled rolls;

a pair of pinch rolls for pinching a strip continuously cast by said chilled rolls and feeding the same to a succeeding process;

an enclosure with lateral side walls confronting widthwise edges of the strip and enclosing the strip in a range from the chilled rolls to the pinch rolls;

chilled-roll sealing members between the enclosure and outer peripheries of said paired chilled rolls;

pinch-roll sealing members between the enclosure and outer peripheries of said paired pinch rolls;

a first swing wall arranged in the enclosure adjacent to a downstream side of the chilled rolls and movable toward and away from a surface of the strip;

a first sealing roll rotatably supported by a tip end of said first swing wall in parallel with the chilled rolls;

a second swing wall arranged in the enclosure adjacent to a downstream side of the chilled rolls and movable toward and away from the other surface of the strip;

a second sealing roll rotatably supported by a tip end of said second swing wall in parallel with the chilled rolls;

swing-wall sealing members sealingly arranged between a wall of the enclosure and peripheral edges of the first and second swing walls; and gas supply means for supplying inert gas into the enclosure.

2. A twin roll casting machine according to claim 1, further comprising drive mechanisms for the first and second sealing rolls, respectively.

3. A twin roll casting machine according to claim 1, wherein the first and second swing walls are provided with stoppers configured to abut on each other, the stoppers being shaped such that, when they abut on each other, a gap between the first and second sealing rolls is more than a maximum thickness of the strip from the chilled rolls.

4. A twin roll casting machine according to claim 2, wherein the first and second swing walls are provided with stoppers configured to abut on each other, the stoppers being shaped such that, when they abut on each other, a gap between the first and second sealing rolls is more than a maximum thickness of the strip from the chilled rolls.

5. A twin roll casting machine according to claim 1, further comprising first and second actuators for swinging the first and second swing walls, respectively, and a control mechanism for actuating the first and second actuators such that a required spacing can be retained between the first and second sealing rolls.

6. A twin roll casting machine according to claim 2, further comprising first and second actuators for swinging the first and second swing walls, respectively, and a control mechanism for actuating the first and second actuators such that a required spacing can be retained between the first and second sealing rolls.

7. A twin roll casting machine according to claim 3, further comprising first and second actuators for swinging the first and second swing walls, respectively, and a control mechanism for actuating the first and second actuators such that a required spacing can be retained between the first and second sealing rolls.

8. A twin roll casting machine according to claim 4, further comprising first and second actuators for swinging the first and second swing walls, respectively, and a control mechanism for actuating the first and second actuators such that a required spacing can be retained between the first and second sealing rolls.

9. A twin roll casting machine comprising:

a pair of chilled rolls;

a pair of pinch rolls for pinching a strip continuously cast by said chilled rolls and feeding the same to a succeeding process;

an enclosure with lateral side walls confronting widthwise edges of the strip and enclosing the strip in a range from the chilled rolls to the pinch rolls;

chilled-roll sealing members between the enclosure and outer peripheries of the paired chilled rolls;

pinch-roll sealing members between the enclosure and outer peripheries of the paired pinch rolls;

table rolls arranged in a horizontal portion within the enclosure such that the strip from the chilled rolls is configured to be conveyed to the pinch rolls;

a third swing wall within the enclosure above the table rolls adjacent to an upstream side of the pinch rolls and movable toward and away from an upper surface of the strip;

a third sealing roll rotatably supported by a tip end of said third swing wall in parallel with the chilled rolls;

a swing-wall sealing member sealingly arranged between a wall of the enclosure and a peripheral edge of said third swing wall; and gas supply means for supplying inert gas into the enclosure.

10. A twin roll casting machine according to claim 9, further comprising a drive mechanism for the third sealing roll.

11. A twin roll casting machine according to claim 9, further comprising stoppers adapted to limit a roll spacing when the third sealing roll is brought close to the corresponding table roll such that the spacing is more than a maximum thickness of the strip.

12. A twin roll casting machine according to claim 10, further comprising stoppers adapted to limit a roll spacing when the third sealing roll is brought close to the corresponding table roll such that the spacing is more than a maximum thickness of the strip.

* * * * *